US007911336B1

(12) United States Patent
Hummer

(10) Patent No.: US 7,911,336 B1
(45) **Date of Patent: *Mar. 22, 2011**

(54) CONTAINER MONITORING SYSTEM

(76) Inventor: Gregory J. Hummer, Shaker Heights, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/707,062

(22) Filed: Feb. 17, 2010

Related U.S. Application Data

(63) Continuation-in-part of application No. 11/705,142, filed on Feb. 9, 2007, now Pat. No. 7,667,593, which is a continuation-in-part of application No. 10/998,324, filed on Nov. 29, 2004, now Pat. No. 7,176,793.

(51) Int. Cl.
*G08B 1/08* (2006.01)

(52) U.S. Cl. ..... 340/539.13; 340/539.1; 340/539.17; 340/539.26; 340/541; 340/426.19; 340/825.49; 340/825.69

(58) Field of Classification Search ..... 340/539.13, 340/539.1, 539.17, 539.26, 541, 426.19, 340/825.49, 825.69, 531, 540, 568.1, 686.1; 235/380, 384
See application file for complete search history.

(56) References Cited

U.S. PATENT DOCUMENTS

| | | | | |
|---|---|---|---|---|
| 7,005,982 | B1 | 2/2006 | Frank | |
| 7,109,859 | B2 * | 9/2006 | Peeters | 340/539.11 |
| 7,151,447 | B1 * | 12/2006 | Willms et al. | 340/540 |
| 2005/0236478 | A1 | 10/2005 | St. Clair et al. | |

* cited by examiner

*Primary Examiner* — Hung T. Nguyen
(74) *Attorney, Agent, or Firm* — Fay Sharpe LLP

(57) ABSTRACT

A detection system for an enclosed container includes many nanosensors for detecting materials harmful to human beings within an enclosed container and transmitting a corresponding resonance frequency. The nanosensors are carried on or within walls of the container, e.g., embedded in a coating. At least one detection device detects a condition of the nanosensors and outputs a signal responsive thereto, which can be received by a monitoring system external to the container. Containers which have harmful materials within them can be inspected or stopped before entering the country.

22 Claims, 3 Drawing Sheets

CONTAINER MONITORING SYSTEM

This is application claims the priority, as a continuation in part, of application Ser. No. 11/705,142, filed on Feb. 9, 2007 (to be issued on Feb. 23, 2010, as U.S. Pat. No. 7,667,593), and claims the priority of application Ser. No. 10/998,324, filed on Nov. 29, 2004 (now U.S. Pat. No. 7,176,793), from which the Ser. No. 11/705,142 application claims priority. The disclosures of both of these applications are incorporated herein by reference in their entireties.

BACKGROUND

The present exemplary embodiment relates to the detection arts. It finds particular application in conjunction with cargo containers which are used to ship products, foodstuffs, and other materials from one country to another, and will be described with particular reference thereto. However, it is to be appreciated that the present exemplary embodiment is also amenable to other like applications.

Cargo containers are widely used for shipping materials by land or by water from one country to another. Knowing the contents of such containers has become of increasing importance in detecting potential threats. It has thus become extremely important to monitor the contents of such containers for harmful materials, such as explosives, harmful biological material, and radiation materials.

U.S. Pat. No. 7,176,793 discloses a detection device in the form of a strip for use in an enclosed container. The detection strip includes nanosensors for detecting materials that are harmful to human beings within an enclosed container and for transmitting a corresponding resonance frequency. One or more detection strips are initially placed within a container, depending on the size of the container. The detection devices are designed to send off specific resonant frequency signals which are correlated to any harmful material detected within the container. A serial number computer chip is provided for specifically identifying the detection device and transmitting a corresponding resonance frequency, which allows the container to be identified. A power source is provided for operating the detection strip. A hand held or stationary monitor is provided for monitoring the container for any signals given off from the detection strips within the container. The detection devices are designed to give off a predetermined amount of background signal. In consequence, if no such signals are received, the container is highly suspect as being tampered with, allowing such a container to be quickly removed and its contents examined.

For some applications, hazardous materials may be at relatively low concentrations, for example hazardous nuclear materials may be distributed in amongst other materials or chemical or biological warfare agents may be in small concentrations within the container. As a consequence, the detection device may give off an intermittent or no signal. One solution is to enlarge the size of the detection strip. However, very large detection strips may be unwieldy and difficult to attach to the container.

The exemplary embodiment provides a solution to this problem by incorporating the nanosensors in a coating which is applied to one or more interior walls of the container. The nanosensors are extremely small detectors, of micro, meso, or nano size. The signals output by the nanosensors can be received by one or more detection strips which communicate the signals to the exterior monitor.

BRIEF DESCRIPTION

In accordance with one aspect of the exemplary embodiment, a detection system for an enclosed container includes many nanosensors for detecting materials harmful to human beings, within an enclosed container and transmitting a corresponding resonance frequency and at least one detection device which detects a condition of the nanosensors and outputs a signal responsive thereto.

In another aspect, in combination, a cargo container in which any suitable cargo is placed for transport from one place to another place, a detection system disposed in the container for detecting tampering with the container, the detection system including numerous nanosensors which are designed to transmit a predetermined frequency, means of storing and transmitting information about the condition of the nanosensors and optionally a serial number specific to the detection system using an ESN computer chip, and a power source for operating the detection system.

In another aspect, a method for detecting harmful materials including embedding nanosensors in walls of an enclosed container or in a coating applied to the container walls and monitoring signals output by the nanosensors with a monitoring device external to the container.

DETAILED DESCRIPTION

Figure 1:
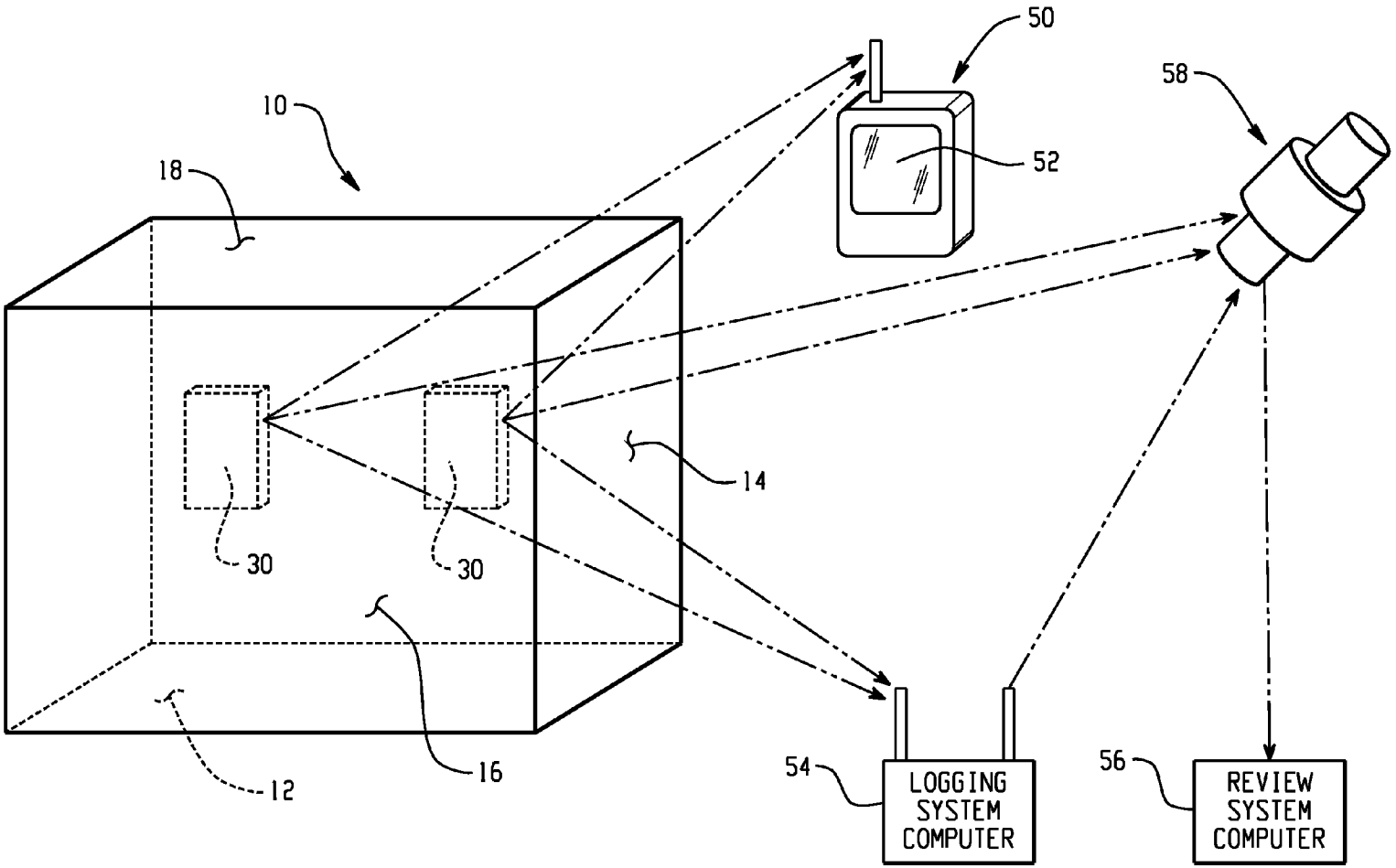
FIG. 1 is a perspective view of a shipping container and monitoring system in accordance with one aspect of the exemplary embodiment.

With reference to FIG. 1, there is shown a container 10 which can be of any size, including large cargo containers. Cargo containers 10 are generally made of metal and include eight walls, namely, a bottom 12 with a pair of opposing, upstanding similar sides 14, a pair of similar opposing ends 16, and a top 18, for covering and closing the cargo container 10. The walls 12, 14, 16, 18 may be made of metal, such as steel or alumina, or form non-metallic material, such as carbon fiber, or a combination thereof.

Figure 2:
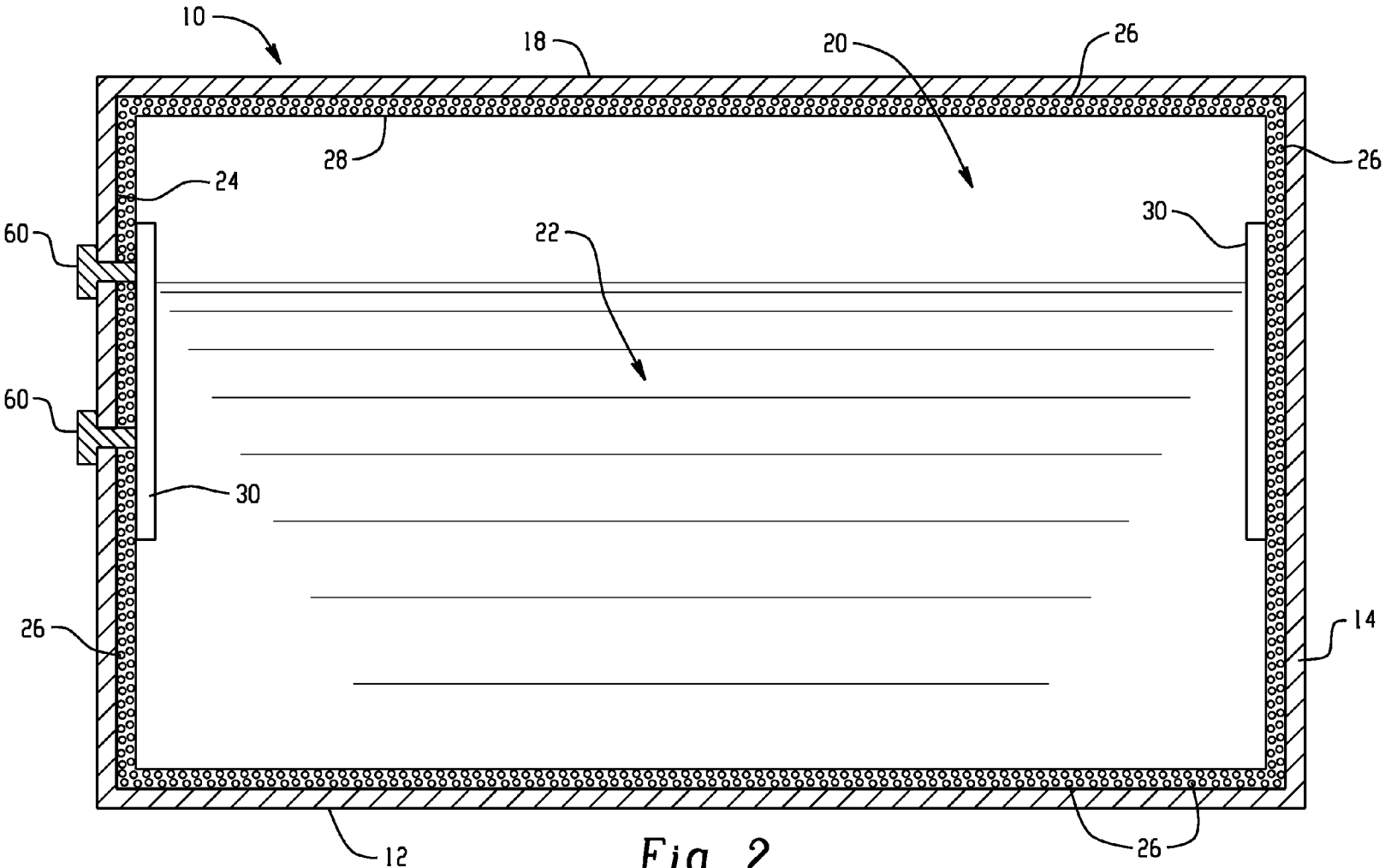
FIG. 2 is a cross-sectional view of the shipping container of FIG. 1.

As illustrated in FIG. 2, the walls 12, 14, 16, 18 define an interior space 20 for receiving a cargo 22, such as a liquid, solid or other material. Each wall has an interior surface 24, some or all of which may be in contact with the cargo 22. Extremely small detectors, of micro, meso, or nano size, which are referred to herein as nanosensors 26, are carried by the interior surfaces 24 of walls of the container. The nanosensors may detect harmful materials, such as explosives, radioactive materials, harmful chemicals, such as chemical warfare agents, nerve gases, biological materials, such as such as gases, anthrax and other germ warfare agents, narcotics and other illegal drugs, or combinations thereof. In some cases, nanosensors may be configured for detection of heat in the container wall, e.g., a temperature above those normally experienced by the container 10 which is indicative of tampering, e.g., from the heat applied by a blow torch. In other embodiment, the nanosensors are capable of detecting small changes in heat resulting from the presence of humans or animals in the container.

In one embodiment, one or more of the walls' interior surfaces 24 is at least partially covered with a coating 28, such as a paint, in which many thousands, millions, or billions of nanosensors 26, are embedded. The coating 28 is one which is free of any of the harmful materials which are to be detected by the nanosensors. By free it is meant that any harmful materials are at too low a concentration for the nanosensors to detect. The nanosensors may be embedded in a surface of the coating, for example, by spray painting the coating on the container walls and, before the coating is set, spraying the nanosensors on to the surface such that the detectors are exposed to the cargo.

In another embodiment, the nanosensors are embedded in an interior layer of the container wall, such as in a carbon fiber wall or layer of the container, such that they are exposed to the cargo.

The nanosensors combine to detect many different harmful materials, such as explosives, radioactive materials, harmful chemicals, and biological gases, germs, illegal drugs, or combinations thereof, and the like. In particular, the nanosensors 26 produce and transmit resonant frequencies corresponding to the harmful materials detected. Depending on the materials to be detected, different nanosensors 26 may be used, singly or in combination. For example, the nanosensors may be in the form of particles comprising a substrate such as carbon (e.g., carbon nanotubes) to which is bound a receptor molecule that is specific for a particular harmful substance (or class of harmful substances) or responsive to a change in physical conditions, such as responsive to heat.

Depending on the size of the container 10, one or more detection devices 30 are placed within the container 10. In the exemplary embodiment, the detection devices are located proximate the nanosensors, e.g., fixed to an interior surface of a wall on top of the coating or within it. The exemplary detection devices are capable of withstanding extremes of temperatures, humidity, vibrations, and salt air. Resonant frequencies emitted by the nanosensors 26 are carried through the coating or container wall to the detection device 30. The transfer of resonant frequencies may be aided by wires positioned in the coating 28 or on the container wall or by having multiple collectors, serving as repeater stations, disposed around the container walls which forward the resonant frequencies, e.g., amplified, to the detection device 30. The nanosensors can be configured to set off adjacent like sensors so that a very large volume of a particular type of nanosensor (s) change their resonant frequency. This chain-like reaction thus helps to detect the very small voltage change over a distance.

Figure 3:
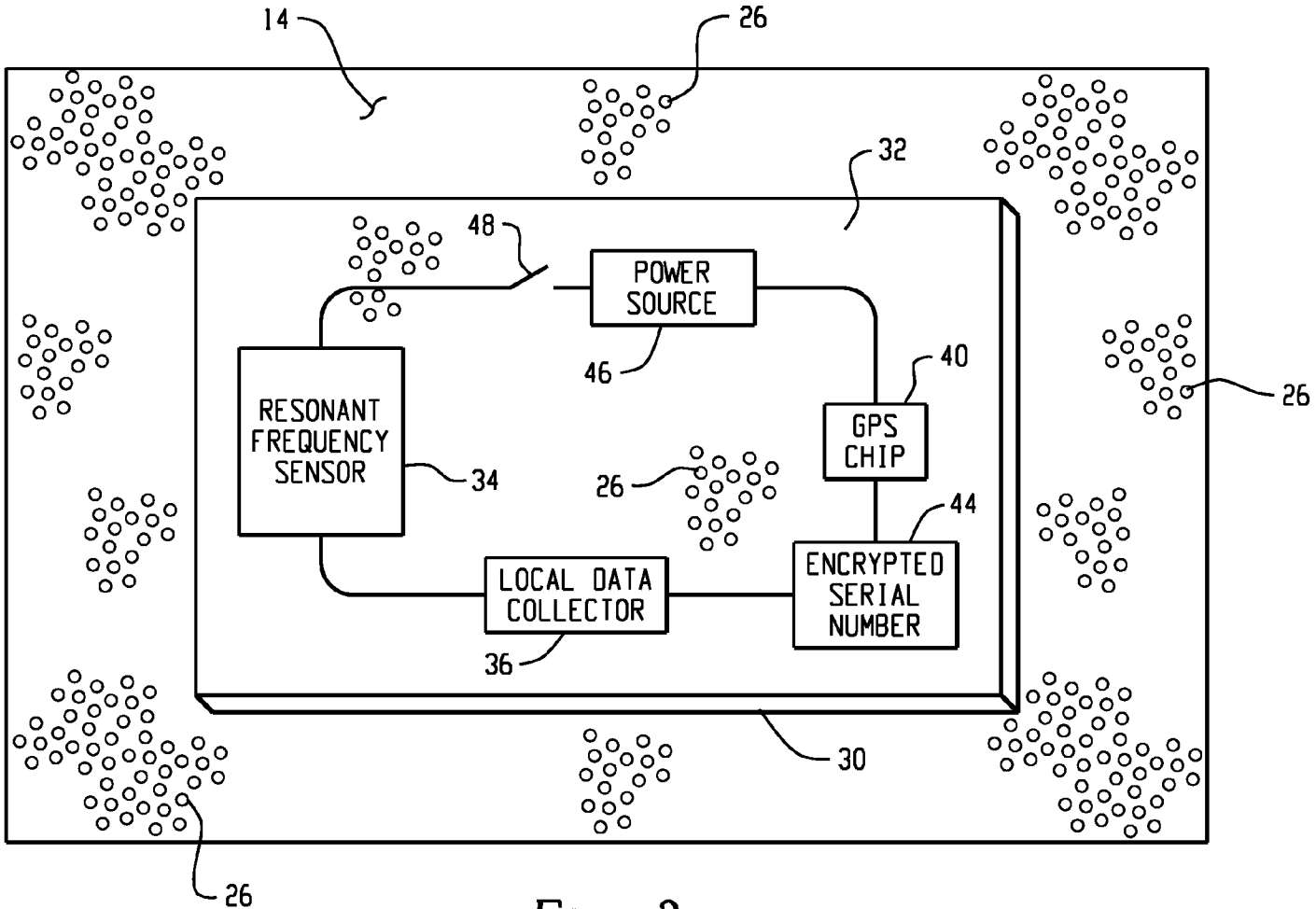
FIG. 3 is a top view of one embodiment of a detection device mounted on an interior wall of the container of FIG. 1.

The detection device 30, as best seen in FIG. 3, comprises a flexible strip 32, which may be composed of any suitable plastic material. The detection device 30 includes a sensor chip 34 or other means for measuring the resonant frequency. The sensor 34 may be embedded in or otherwise supported by the strip 32. The sensor chip 34 detects the resonant frequencies transmitted by the nanosensors or intermediate collectors, e.g., as a small change in voltage, and generates a signal responsive thereto, such as a voltage signal or simply an amplification of the resonant frequency. One specific signal may be reserved for chemical warfare agents, another for radioactive materials, and so forth. Or, each particular harmful material may have its own specific signal. A transmitter chip 36, such as an LDA (local data adapter/collector), capable of multiplexing data transmitted by the encrypted serialized chip is supported on the strip. In one embodiment, the LDA 36 is capable of data transmission by satellite uplink and/or by direct line of sight up to 15-30 miles. U.S. Pat. No. 7,292,828, the disclosure of which is incorporated herein by reference, discloses one multichannel transmitter which employs wireless telemetry to send signals indicative of harmful materials to a remote receiver that may be used herein. Sensor chip 34 and LDA 36 may be separate or combined into a single chip.

In addition to the nanosensors which emit resonant frequencies in response to detection of harmful materials, a separate and distinct calibrated general background resonant frequency may be emitted by a specific group of the nanosensors 26. These nanosensors 36 may be embedded in the coating or container wall together with the nanosensors 26 and/or are embedded in the strip 32.

A global positioning system (GPS) computer chip 40 may be embedded in the detection strip 32 for providing a signal representative of the location of the strip and its associated container. For containers 10 which are below deck and/or covered by many other containers, the chip 40 may receive a signal from a corresponding GPS chip in a local container if the satellite signal is too weak to be picked up. An encrypted serial numbered (ESN) computer chip 4 may also be embedded in or otherwise supported by the strip 32. The ESN chip 44 generates a signal corresponding to the device's unique serial number which may also be transmitted via the LDA. The components of the detection device 30, such as the sensor chip, LDA chip, and GPS chip may all be powered by a single power source or by separate power sources, such as a battery. For example, a low voltage motion activated power source 46 is carried by the strip. The power source 46 may be disconnected from the components by a magnetic switch 48 which completes the circuit with the components 34, 36, 40, 44 only intermittently. The container 10, when moved, may activate the power source 46 to maintain operation of the detection device 30. In this way, the power source is not drained two quickly. A battery thus may last for about two years before it needs to be replaced.

The exemplary GPS chip 40 stores not only the origin of a particular container 10, but tracks the route which the container 10 travels from the origin to its destination which, for our purposes, is the United States. This information can be readily accessed from the GPS chip 40. The ESN chip 44 stores an encrypted serial number that is specific to the one or more particular detection devices 30, which are assigned to the container 10 involved. The ESN chip 44 produces and transmits a distinct resonant frequency which can be accessed and used to track down the owner of the detection devices 30 within the container 10, since a log of the owner of every detection device 30 is maintained. The strip may be equipped with anti tamper logic, e.g., in the LDA chip 44.

As illustrated in FIG. 1, an external monitoring system may include any suitable hand-held or stationary monitoring device 50. This is used to monitor the resonant frequencies produced/signals generated and transmitted by the nanosensors 26 via the detection device 30 and the GPS and ESN computer chips 40, 44 to reveal the contents of a container 10, whether the contents be hazardous or not. The monitoring device 50 is able to detect a separate and distinct calibrated general background resonant frequency from some of the numerous nanosensors 26, embedded in the coating 28 or detection strip 32 as a means to ensure that the detection strip 32 is functioning. If not, the container 10 is considered suspect and removed to a remote location for further examination and review or, in some cases, the suspect container 10 may be rejected and sent back to its place of origin. The monitoring device 50 may designed to translate the resonate frequencies received into digital readouts on a screen 52 of the monitoring device 50, and provide printouts at a remotely located printer, if desired. In one embodiment, the monitoring system includes a computer logging system 54 which receives the signals from the devices 30 in the containers 10 and uploads them periodically to a corresponding review system computer 56 remotely located, e.g., located on shore, e.g., in the port of entry, or at a customs post. The signals from the logging system 54 may be transmitted via a satellite link 58. In this way, either or board ship or in port, a reviewer can track the activity in each of the hundreds or thousands of containers on board a container ship wishing to enter port determine if any of the containers pose a threat, and either refuse entry of the container ship to port or provide for an inspection of the container at sea or when it reaches port. For vehicles arriving by land, the reviewer can track the contents of the containers before they reach a customs post or weigh station and prevent the vehicle from crossing the border if appropriate.

The detection strips 32 may each have a sticky side which can firmly adhere to sides of the container 10, e.g., to the surface of the coating 28 or to a coating-free area of the container wall. When not in use, the sticky side of the detection strip 32 is covered by a protective strip which can be peeled away when the strip 32 is ready to be applied to the container 10. The sticky side of each detection strip 32 may be provided with one or a number of metal studs or strips 60 for contact with the metal, carbon fiber, or painted interior surfaces of a container 10 to facilitate or improve the transmission of the resonant frequencies from the detection devices 30 to a monitoring device 50 outside the container 10. For example, a single, continuous metal strip or stud 60 may be placed longitudinally of the detection strip 32 between the opposing marginal edges of the detection strip 32, or a number of similar, short metal studs 60 may be spaced longitudinally of the detection strip 32 in transversely oriented relation on the detention strip 32 as shown in FIG. 3.

As will be appreciated, while the exemplary components 34, 36, 40, 44 and power source 46 are conveniently located on a single strip, in other embodiments, some of the components, such as the GPS system, may be located on a separate strip or otherwise mounted to the container wall.

Thus, there has been described a unique detection system comprising a detection device 30 and nanosensors 26 that are placed within an enclosed space 20 of a container 10 to detect any solids, liquids, or gases which may prove to be harmful to human beings. For example three separate detection devices 30, disposed against the top and adjacent two sides, midway between the opposing ends of the container 10, may be sufficient to detect signals from the nanosensors 26 corresponding to harmful materials in a standard size cargo container 10. Each detection device 30 may have its own distinct ESN computer chip 44. Otherwise, there would be no way to tell if one of the ESN computer chips 44 was destroyed or removed from the container 10, if all three ESN computer chips 44 were identical and transmitted the same resonant frequency.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A detection system for an enclosed container, comprising:

many nanosensors for detecting materials harmful to human beings within an enclosed container and transmitting a corresponding resonance frequency; and at least one detection device which detects a condition of the nanosensors and outputs a signal responsive thereto.

2. The detection system of claim 1, wherein the nanosensors are embedded in one or more walls of the container.

3. The detection system of claim 1, wherein the nanosensors are embedded in a coating forming an inner surface of walls of the container.

4. The detection system of claim 1, wherein the detection device comprises a strip which supports at least one of:

a sensor which detects the transmitted resonant frequencies; and a transmitter which transmits signals in response to the detected transmitted resonant frequencies.

5. The detection system of claim 1, wherein the detection device includes an encrypted serial numbered (ESN) computer chip which stores and transmits information about an encrypted serial number that is specific to the one or more particular detection devices.

6. The detection system of claim 1, wherein the detection device includes a global positioning system computer chip for identifying at least one of origin and travel of the detection device and container to which the detection device is attached.

7. The detection system of claim 1, wherein the detection device includes a power source.

8. The detection system of claim 1, wherein the detection device is calibrated to produce and transmit a distinct resonant frequency which is independent of any other frequencies transmitted by the detection device.

9. The detection system of claim 1, wherein the detection device includes at least one metal stud embedded in a sticky side of the strip for contacting walls of the container to facilitate and improve transmission of resonant frequencies from the detection device inside a container.

10. The detection system of claim 1, wherein the nanosensors are designed to detect one or more harmful materials selected from the group consisting of harmful explosives, chemicals, biological materials, radioactive materials, and illegal drugs.

11. The detection system of claim 1, wherein at least some of the nanosensors are designed to detect heat.

12. The detection system of claim 1 in combination with a monitoring device for receiving signals from the detection device and translating such frequencies into digital readouts on the monitoring device and/or transmitting information about the containers based on the signals to a computer device or printer at a remote location.

13. The detection system of claim 12, wherein the monitoring device is stationary and remote from a container inside which a detection device is located.

14. The detection device of claim 12, wherein the monitoring device includes a hand held device which is outside a container in which a detection strip is located.

15. In combination, the detection system of claim 12 and an enclosed container to be monitored for said harmful materials.

16. In combination, the detection system of claim 1 and an enclosed container to be monitored for said harmful materials.

17. The detection system of claim 16, wherein the container is a cargo container in which foreign products and foodstuffs are shipped into the United States of America.

18. The detection system of claim 17, wherein at least one detection device and multiplicity of embedded nanosensors are used in every cargo container entering the United States.

19. In combination:

a) a cargo container in which any suitable cargo is placed for transport from one place to another place;

b) a detection system disposed in the container for detecting tampering with the container, the detection system including numerous nanosensors which are designed to transmit a predetermined frequency;

c) means of storing and transmitting information about the condition of the nanosensors and optionally a serial number specific to the detection system using an ESN computer chip; and d) a power source for operating the detection system.

20. The combination of claim 19, further comprising a global positioning computer chip for identifying at least one of origin and travel of the container.

21. The combination of claim 19, further comprising means outside the container for receiving resonant frequencies transmitted from inside the container or signals generated by the detection system in response thereto.

22. A method for detecting harmful materials using hardware devices comprising:

embedding nanosensors in walls of an enclosed container or in a coating applied to the container walls; and monitoring signals output by the nanosensors with a monitoring device external to the container.

* * * * *